United States Patent [19]

Gullickson

[11] Patent Number: 4,520,714

[45] Date of Patent: Jun. 4, 1985

[54] AERATION DUCT SYSTEM

[76] Inventor: Myron L. Gullickson, P.O. Box 35, Barons, Alberta, Canada, T0L 0G0

[21] Appl. No.: 455,558

[22] Filed: Jan. 4, 1983

[30] Foreign Application Priority Data

Sep. 27, 1982 [CA] Canada ..... 412303

[51] Int. Cl.[3] ..... E04H 7/24

[52] U.S. Cl. ..... 98/56; 34/232

[58] Field of Search ..... 98/55, 56, 57; 34/232, 34/233

[56] References Cited

U.S. PATENT DOCUMENTS

| | | | |
|---|---|---|---|
| 106,961 | 8/1870 | Raymond | 98/55 |
| 508,363 | 11/1893 | Blair | 98/55 |
| 1,987,903 | 1/1935 | Houdry | 34/232 X |
| 2,590,416 | 3/1952 | Johnson | 98/56 |
| 2,907,036 | 9/1959 | Collins et al. | 98/56 |
| 2,962,954 | 12/1960 | Webb | 98/56 |
| 3,279,094 | 10/1966 | Blanton, Jr. | 98/56 X |

FOREIGN PATENT DOCUMENTS

| | | | |
|---|---|---|---|
| 1072198 | 12/1959 | Fed. Rep. of Germany | 98/56 |
| 2027180 | 2/1980 | United Kingdom | 34/91 |

*Primary Examiner*—Harold Joyce

*Attorney, Agent, or Firm*—William R. Hinds; George H. Dunsmuir

[57] ABSTRACT

An aeration system for grain bins includes a plurality of outlet ducts extending radially outwardly from a central manifold when the grain bin has a flat floor; and a plurality of outlet ducts extending radially upwardly and outwardly from the bottom center of the bin when the floor of the bin is conical. Each outlet duct is defined by a pair of elongated, contiguous side walls which define a triangle with the floor of the bin; and a plurality of louver-type openings in such side walls for discharging air into the contents of the bin. Centrifugal or other fans are used to supply air to the manifold and outlet ducts.

11 Claims, 5 Drawing Figures

AERATION DUCT SYSTEM

BACKGROUND OF THE INVENTION

This invention relates to an aeration system, and in particular to a grain bin aeration system.

There is a large number of patents relating to apparatus which could be used to aerate granular material. In the present case, the term "aeration" is intended to mean the introduction of air, i.e. for drying grain. The patents relating to such apparatus include U.S. Pat. Nos. 1,971,852, issued to P. Goebels on Aug. 28, 1934; 2,292,897, issued to N. Nielsen on Aug. 11, 1942; 3,097,828, issued to G. Grun on July 16, 1963; 3,291,457, issued to W. Hermanns on Dec. 13, 1966; 3,582,046, issued to E. E. Mueller et al on June 1, 1971; 3,647,188, issued to P. E. Scott on Mar. 7, 1972; 3,656,717, issued to H. Klein et al on Apr. 18, 1972; 3,671,018, issued to C. W. McKibben et al on June 20, 1972; 3,973,757, issued to H. Klein et al on Aug. 10, 1976; and 4,185,926, issued to W. L. Lyon on Jan. 29, 1980.

Most of the apparatus described in the above identified patents are somewhat complicated and/or expensive, including multi-inlet systems and many pipe sections. Moreover, for the most part, the systems are builtin systems, i.e. structures which are incorporated in the buildings during construction. Thus, the systems do not lend themselves to existing bins, since substantial reconstruction of the existing structure would be required. Thus, in spite of the large volume of art in the area, there still exists a need for a simple, effective system for aerating a grain bin.

The object of the present invention is to provide a relatively simple aeration system, which is easy to install.

SUMMARY OF THE INVENTION

Accordingly, the present invention relates to an aeration system for a grain bin of the type including a side wall, a top wall and a floor, and at least one blower for blowing air into the bottom of said bin, said system comprising a manifold for receiving air from said blower; a plurality of outlet ducts for mounting on the floor of the bin in fluid communication with said manifold for receiving air from said manifold, each said duct including a pair of contiguous walls defining two adjacent sides of a triangle, the third side of which is defined by the floor of a bin when the system is installed in such bin, and a plurality of openings in said duct walls for discharging air into the bin.

BRIEF DESCRIPTION OF THE DRAWINGS

The invention will now be described in greater detail with reference to the accompanying drawings, which illustrate preferred embodiments of the invention, and wherein.

DESCRIPTION OF THE PREFERRED EMBODIMENT(S)

Figure 1:
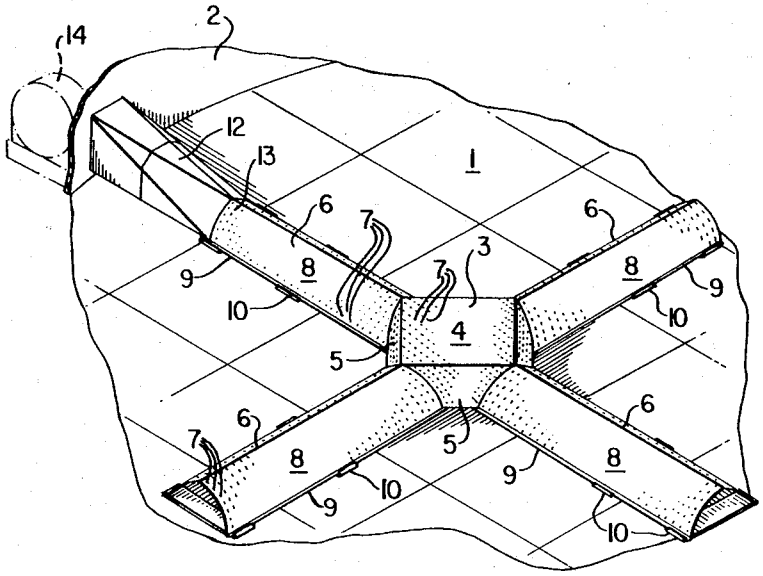
FIG. 1 is a schematic perspective view from above of an aeration system in accordance with the present invention in a flat bottom grain bin.

With reference to FIG. 1, one embodiment of the present invention is intended for use in a grain bin which has a flat horizontal floor 1 and a cylindrical side wall 2. The aeration system includes a generally square manifold 3 which is mounted on the centre of bin floor 1. The manifold 3 is defined by a planar top wall 4 and slightly convex side walls 5 extending downwardly to the floor 1 of the bin. An outlet duct 6 extends outwardly from each corner of the manifold 3 towards the side wall of 2 of the bin. Openings 7 are provided in the top wall 4 and side walls 5 of the manifold 3, and in each of the outlet ducts 6.

Each outlet duct 6 is defined by an elongated strip of metal which is folded along the longitudinal centre thereof to define contiguous sides 8. The sides 8 are slightly bowed, and with the floor 1 of the bin define a substantially triangular figure. The bottom free edges of the sides 8 of the outlet ducts 6 are defined by outwardly extending flanges 9, which are interconnected by tension straps 10, which are described in greater detail hereinafter. The tension straps 10 maintain the sides of ducts 6 a constant distance apart, i.e. prevent flattening of the ducts 6 under a load of grain in the bin.

Air is introduced into the outlet ducts 6 and the manifold 3 through an inlet duct 12 which is connected to the outer end 13 of one of the ducts 6. The outer ends of the remaining outlet ducts may be closed by covers (not shown). Air is blown into the outlet duct 12 by centrifugal or axial fan 14 outside of the bin for distribution through the manifold 3 and the outlet ducts 6 to the contents of the bin.

Figure 2:
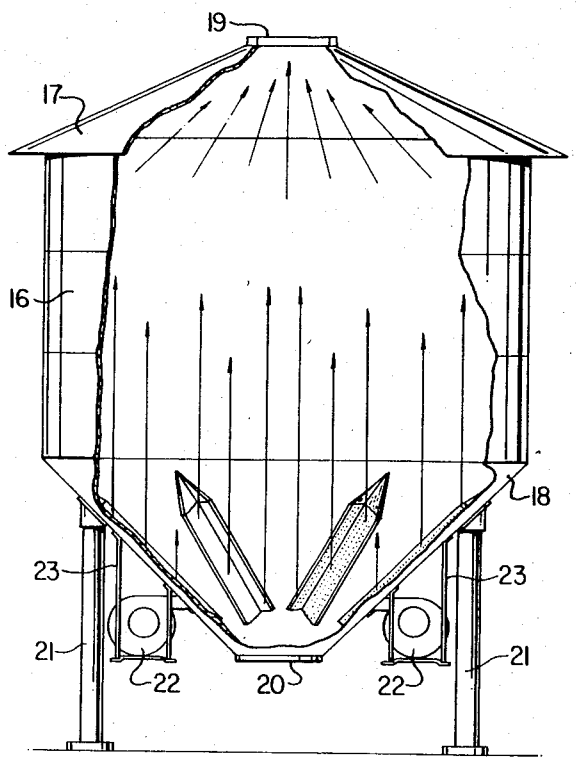
FIG. 2 is a schematic, partly sectioned side elevation view of a grain bin hopper bottom incorporating an aeration system in accordance with the present invention.

Referring to FIG. 2, a second embodiment of the invention is intended for use in a grain bin of the type including a cylindrical side wall 16, a frusto-conical top wall 17, and a frusto-conical floor 18. Grain is loaded into the bin through an inlet opening 19 in the top wall 17, and discharged from the bin through an outlet opening 20 in the floor 18. The bin is supported above the ground by posts 21.

Figure 4:
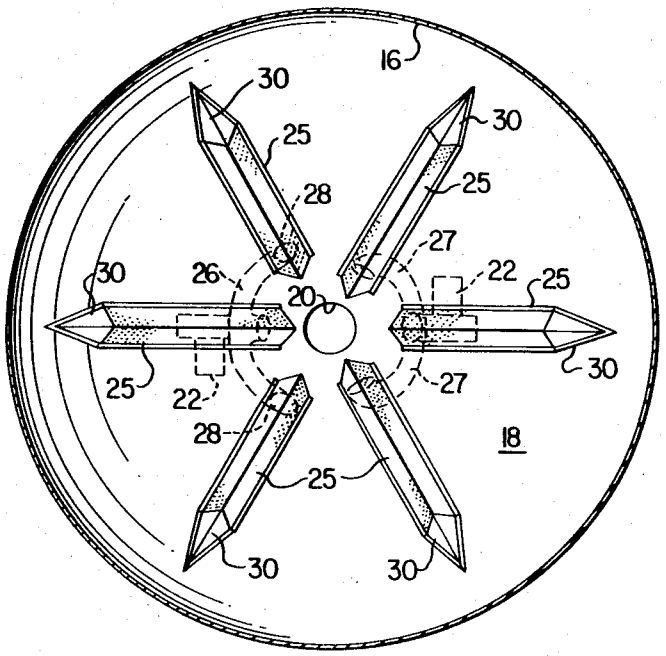
FIG. 4 is a plan view of the floor of the grain bin of FIG. 3.
Figure 3:
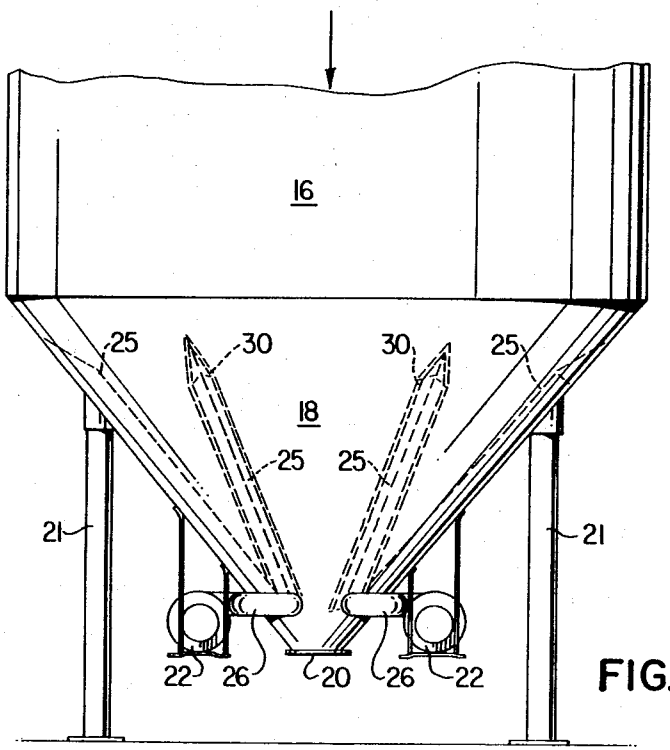
FIG. 3 is a side elevation view of the bottom end of the grain bin of FIG. 2 on a larger scale showing a pair of manifolds.

Air is introduced into the bin by centrifugal fans 22, which are mounted on brackets 23 secured to the exterior surface of the floor 18 of the bin on opposite sides thereof. The air is distributed to a plurality of outlet ducts 25 by a pair of manifolds 26 (FIGS. 3 and 4). The manifolds 26 are also mounted outside of the bin, and include a plurality of arms 27 for feeding air to each duct 25. The ducts 25 are similar in structure to the outlet ducts 6 of FIG. 1. Air is introduced into the ducts 25 through inlet openings 28 in the floor 18 of the bin. The ducts 25 are spaced equidistant apart, and extend upwardly and outwardly along the bin floor 18. The top, outer end of each duct 25 is closed by a pointed end cap 30. The ducts 25 and the end caps 30 are provided with perforations 31 for discharging air into the bin. The perforations 31 are similar to the outlet openings 7 in the outlet ducts 6.

Figure 5:
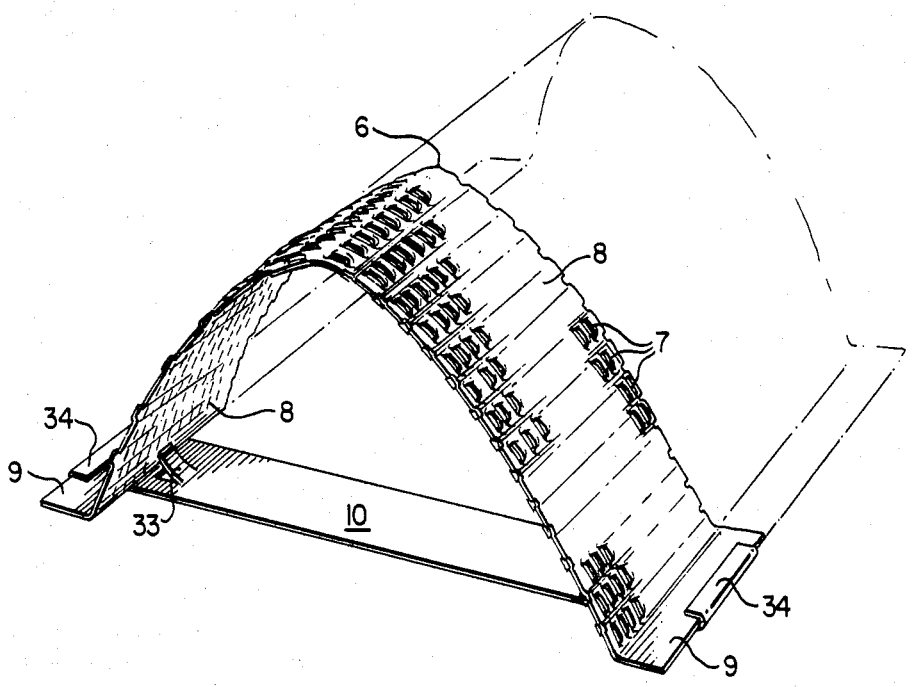
FIG. 5 is a schematic perspective view from above and one end of an outlet duct for use in the aeration system of the present invention.

With reference to FIG. 5, which shows the outlet duct 6 and the tension strap 10 in detail, such outlet duct includes outlet openings 7 which are in the form of louvers. During installation, the duct 6 or 31 is installed in such manner that the louvers open in the direction of air flow. Thus, clogging of the openings 7 or 31 by the particles of grain is prevented or at least reduced to a minimum. A raised lug 33 is provided on each tension strap 10 near each end thereof. The lug 33 presses against the inner surface of the duct 6 or 25, and the ends 34 of the strap 10 are folded around the flange 9 to secure the strap in position and to prevent outward movement of the sides of the duct 6 or 25.

Thus, there has been described a relatively simple grain bin aeration system, which can easily be installed in new or existing bins.

What I claim is:

1. An aeration system for a grain bin of the type including a side wall, a top wall and a floor, and at least one blower for blowing air into the bottom of said bin, said system comprising a manifold for receiving air from said blower; a plurality of outlet ducts for mounting on the floor of the bin in fluid communication with said manifold for receiving air from said manifold, each said duct including a pair of contiguous walls defining two adjacent sides of a triangle, the third side of the triangle being defined by the floor of a bin when the system is installed in such bin, and a plurality of openings in said duct walls for discharging air into the bin, each said duct comprising an elongate strip of metal folded along its longitudinal center line to form said contiguous walls, said walls terminating at their bottom free edges in outwardly extending flanges for bearing against the floor of the bin, and a plurality of spaced metal tension strips extending between said flanges and having their end portions passing under and folded around the outer edges of said flanges to prevent movement of said flanges away from each other.

2. An aeration system according to claim 1, wherein, when the floor of the bin is flat, said manifold is mounted substantially in the centre of the bin floor, and said ducts extend radially outwardly therefrom.

3. An aeration system according to claim 2, including inlet duct means for mounting in a side wall of said bin for introducing air into one said outlet duct, whereby air is introduced into said manifold through said one outlet duct.

4. An aeration system according to claim 1, wherein the contiguous walls of each said outlet duct are louvered to prevent blockage by granular material in the bin.

5. An aeration system according to claim 1, wherein, when the bin has a conical floor, said manifold is mounted externally of said floor, and said outlet ducts extend upwardly along the inclined interior surface of the floor.

6. An aeration system according to claim 5, including a perforated, pointed end cap on the top end of each said outlet duct extending along the inclined interior surface as an extension of the duct and terminating as a pointed end on the inclined interior surface.

7. An aeration system according to claim 1 wherein said tension strips include raised lug members for bearing against the inner surfaces of said contiguous walls adjacent said flanges.

8. An aeration system according to claim 7 wherein said raised lugs comprise portions of said strips bent upwardly out of the plane of the strips.

9. An aeration system for a grain bin of the type including a side wall, a top wall and a conical floor, and at least one blower for blowing air into the bottom of said bin, said system comprising a manifold for receiving air from said blower, said manifold being mounted externally of said floor, a plurality of outlet ducts inside the bin and extending upwardly along the inclined interior surface of the conical floor, each outlet duct being in fluid communication via an opening in the conical floor for receiving air from said manifold, each said duct including a pair of contiguous walls defining two adjacent sides of a triangle, the third side of the triangle being defined by part of the inclined interior surface of said conical floor when the system is installed in such bin, and a plurality of openings in said duct walls for discharging air into the bin.

10. An aeration system according to claim 9, including a perforated pointed end cap on the top end of each said outlet duct extending along the inclined interior surface as a tapered extension of the duct and terminating as a pointed end on the inclined interior surface of the conical floor.

11. An aeration system according to claim 10 wherein said external manifold is connected to said ducts at the lower ends thereof.

* * * * *